US009685054B2

(12) United States Patent
Simmons

(10) Patent No.: US 9,685,054 B2
(45) Date of Patent: Jun. 20, 2017

(54) MOUNTING BRACKET INCLUDING EMERGENCY LIGHTING

(71) Applicant: Michael Simmons, Haymarket, VA (US)

(72) Inventor: Michael Simmons, Haymarket, VA (US)

( * ) Notice: Subject to any disclaimer, the term of this patent is extended or adjusted under 35 U.S.C. 154(b) by 0 days.

(21) Appl. No.: 14/779,008

(22) PCT Filed: Mar. 14, 2014

(86) PCT No.: PCT/US2014/028592
§ 371 (c)(1),
(2) Date: Sep. 21, 2015

(87) PCT Pub. No.: WO2014/152998
PCT Pub. Date: Sep. 25, 2014

(65) Prior Publication Data

US 2016/0049054 A1 Feb. 18, 2016

Related U.S. Application Data

(60) Provisional application No. 61/803,238, filed on Mar. 19, 2013, provisional application No. 61/815,249, filed on Jun. 12, 2013, provisional application No. 61/948,491, filed on Mar. 5, 2014.

(51) Int. Cl.

| | |
|---|---|
| ***G08B 17/00*** | (2006.01) |
| ***G08B 7/06*** | (2006.01) |
| ***F21S 9/02*** | (2006.01) |
| *G08B 29/12* | (2006.01) |
| *G08B 29/14* | (2006.01) |
| *G08B 29/18* | (2006.01) |
| *G08B 17/113* | (2006.01) |

(52) U.S. Cl.
CPC ..... *G08B 7/066* (2013.01); *F21S 9/022* (2013.01); *G08B 7/062* (2013.01); *G08B 17/00* (2013.01); *G08B 17/113* (2013.01); *G08B 29/126* (2013.01); *G08B 29/145* (2013.01); *G08B 29/181* (2013.01)

(58) Field of Classification Search
CPC ..... G08B 7/062; G08B 29/181; F21S 9/022; F21S 9/024
See application file for complete search history.

(56) References Cited

U.S. PATENT DOCUMENTS 4,887,073 A * 12/1989 Nakao ..... G08B 17/113 340/628
5,646,502 A * 7/1997 Johnson ..... H02J 7/022 307/66
6,057,775 A * 5/2000 Sakurai ..... G08B 17/113 340/629

(Continued)

*Primary Examiner* — Andrew Bee
(74) *Attorney, Agent, or Firm* — Richard C. Litman

(57) ABSTRACT

The present invention provides a mounting bracket for supporting a detachable device and includes emergency lighting. In one embodiment, the mounting bracket includes an attachment means for mounting the detachable device, and at least one light source, wherein the mounting bracket is configured to receive power from a first power source, to receive power from a second power source, and to illuminate the at least one light source if the first power source is not available.

19 Claims, 7 Drawing Sheets

(56) References Cited

U.S. PATENT DOCUMENTS

| | | | | |
|---|---|---|---|---|
| 6,181,251 | B1 * | 1/2001 | Kelly | G08B 7/062<br>340/628 |
| 6,499,866 | B1 * | 12/2002 | Logan | G09F 13/04<br>362/234 |
| 7,619,538 | B1 * | 11/2009 | Zarian | G08B 7/066<br>340/326 |
| 2007/0069882 | A1 * | 3/2007 | Mahajan | E05B 65/104<br>340/500 |
| 2008/0295371 | A1 * | 12/2008 | Hsu | G08B 7/062<br>40/570 |
| 2010/0302758 | A1 * | 12/2010 | Wang | F21S 9/022<br>362/20 |
| 2012/0126700 | A1 * | 5/2012 | Mayfield | H05B 37/0272<br>315/86 |

* cited by examiner

MOUNTING BRACKET INCLUDING EMERGENCY LIGHTING

BACKGROUND OF THE INVENTION

1. Field of the Invention

The present invention relates to a mounting bracket. More particularly, the present invention relates to a universal mounting bracket on which to mount a sensing detector or other device, wherein the bracket provides a source of light.

2. Description of the Related Art

Known in the art are sensing detectors such as smoke detectors, fire detectors, carbon monoxide detectors, and the like. These detectors are typically mounted to a wall, a ceiling or another surface in a location and in such a manner as to provide protection to the inhabitants of residential and/or commercial buildings, or other structures in which the sensing detector is located. That is, a sensing detector, such as a smoke detector, is located in such a manner that inhabitants of such a building will be alerted when a dangerous condition is present.

As described above, the sensing detector is typically mounted to a wall, a ceiling, or another surface. To provide such a mounting, the detector is typically mounted to or otherwise coupled with a bracket that is physically mounted to the surface. That is, the bracket acts as an intermediary between the detector and the surface such that the sensing detector is not mounted directly to the surface.

Also, a sensing detector, such as a smoke detector, is typically provided with and connected to an AC power source to supply power for its operation. If the AC power source is unavailable, for example due to a power outage to the building in which the detector is located, a secondary power source, such as a dc power source (i.e., a battery), is typically provided to ensure that the detector is available to provide its safety function. If such an event occurs, for example, if power is lost to the structure in which the detector is located, it would also occur that power would not be available for other electrical devices located within the building, such as normal lighting. In such a situation, it would be an advantage to those inside the building to be provided with a source of light for simple illumination of a space and, more advantageously, to be provided with a system for guiding individuals towards an exit or other point of egress. Even further, it would be advantageous to provide a system that works in conjunction with a fire detection or other type of safety system that intelligently provides for illumination by guiding an inhabitant not only toward an exit or other safe point of egress but also away from a source of danger, such as a location at which a fire or other dangerous event has occurred. The present application includes several inventive concepts, examples of which are described below, to achieve these purposes.

The above information is presented as background information only to assist with an understanding of the present disclosure. No determination has been made, and no assertion is made, as to whether any of the above might be applicable as prior art with regard to the present invention.

BRIEF SUMMARY OF THE INVENTION

Aspects of the present invention are provided to address at least the above-mentioned problems and/or disadvantages and to provide at least the advantages described below. Accordingly, an aspect of the present invention is to provide an attachment apparatus for supporting an external detachable device and for providing a source of light.

Another aspect of the invention is to provide an attachment apparatus for supporting an external detachable device and for providing directional lighting.

Still another aspect of the invention is to provide an attachment apparatus for supporting an external detachable device and for providing a source of light or directional lighting based on an emergency condition.

Yet another aspect of the invention is to provide an attachment apparatus for supporting an external detachable device and for providing a source of light that is controlled by a user, a motion detector, a timer, an illuminance sensor, and the like.

According to an aspect of the present invention, a mounting bracket for supporting a detachable device is provided. The mounting bracket includes an attachment means for mounting the detachable device, and at least one light source, wherein the mounting bracket is configured to receive power from a first power source, to receive power from a second power source, and to illuminate the at least one light source if the first power source is not available.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DESCRIPTION OF THE INVENTION

Figure 1A:
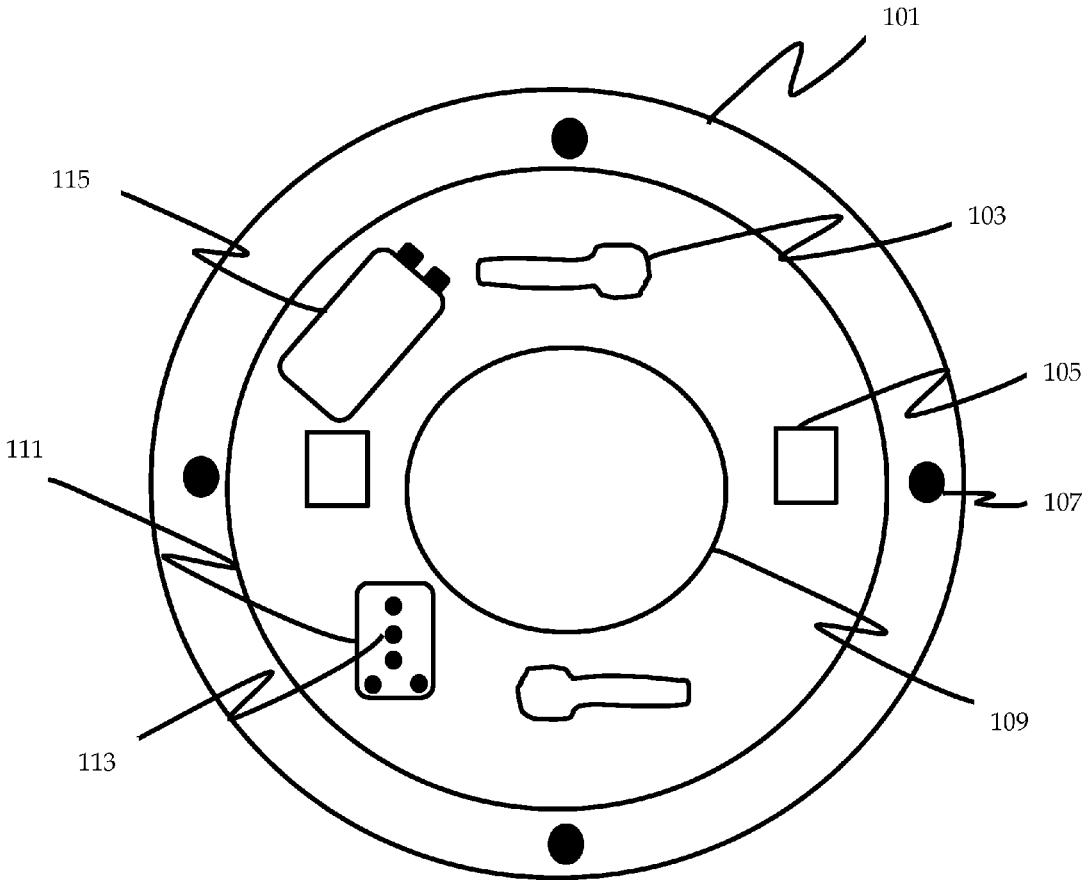
FIG. 1A illustrates an attachment apparatus including emergency lighting according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to their bibliographical meanings, but are merely used by the inventor to enable a clear and consistent understanding of the invention. Accordingly, it should be apparent to those skilled in the art that the following description of exemplary embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following description, the term "building" includes any residential or commercial building, such as a house, a townhouse, an apartment including an apartment complex, a condominium, a hotel, a motel, an office building, a stadium, an arena, a civic center, a museum, a courthouse, a jail, a shopping mall, a movie theater, a government office, and the like, or a combination of any of the above.

The term "normal power" refers to a source of electricity that is used under typical or normal operating conditions of a building. It may also be considered a primary source of power, a first source of power, etc. An example of "normal power" includes electricity from an alternating current (ac) system that is provided from a source that is external to a building and routed through the building by means of wiring internal to the building, such as a 240/120 Vac, a 208/120 Vac system, etc. or any related circuits, such as a branch circuit, commonly found in a typical home or office building. Power provided to a building by an electrical power company is an example of "normal power." Additionally, "normal power" may be any power that is generated, converted, transformed, inverted, rectified, or otherwise altered or produced either internally to or externally from a building. For example, if a building includes a 120 Vac branch circuit that is ultimately supplied power from an external source such as a power company, "normal power" may be power that is generated by rectifying the 120 Vac power into 12 Vdc power.

The term "emergency power" refers to a source of power that may be used to provide electricity to various components, such as those within a building, if normal power is not available. It may also be considered a secondary source of power, a second source of power, an alternate source of power, etc. In implementation, "emergency power" may include electricity from a direct current (dc) device or system as well as electricity from an ac system. Examples of "emergency power" include one or more batteries that are associated with an individual component (e.g., one or more of a 9 Vdc battery, a AAA cell battery, a AA cell battery, a C cell battery, etc.), a dc system in which a dc source (e.g., a battery, an associated charger, etc.) is provided remotely from an individual component and is wired for connection to one or more components, an emergency generator that provides either ac or dc power, is located remotely from an individual component and is wired for connection to one or more components, a solar powered system, an uninterruptible power supply, and the like. As an example, if "normal power" includes 12 Vdc power that is generated by rectifying a 120 Vac source of power, "emergency power" may also include 12 Vdc power that is supplied from a dc system including, for example, a battery, a charger, control circuitry, etc. In that case, the battery may be charged by the "normal power" during normal conditions and the 12 Vdc power can be supplied to remote components from either the normal power source or the emergency power source using the same wiring. Furthermore, "emergency power" may include a plurality of power sources, such as a first battery and a second battery, that may be configured in a variety of ways, such as automatically switching between the first battery and the second battery, user selection of the first battery or the second battery, and the like. Of course, these are merely examples and the "normal power" and the "emergency power" need not be configured exactly as described, for example the "normal power" and the "emergency power" need not be of the same voltage and/or of the same type (e.g., ac or dc).

Attachment Apparatus Having a Lighting Source

An attachment apparatus, such as a mounting bracket, may be provided in order to mount a sensing detector such as a smoke detector, a fire detector, or any detector or similar device to a wall, a ceiling, or other surface. Notably, the inventive attachment apparatus is provided with an emergency lighting source that illuminates upon loss of normal power, upon receipt of an emergency signal, upon receipt of an input signal such as a user selection by a wall switch, a remote control, or other means, or upon any other condition that is recognized as requiring or desiring a source of light. For example, the emergency lighting source provided on the attachment apparatus may come on (e.g., illuminate) automatically upon a loss of normal AC power, may be configured such that it comes on upon receipt of an emergency signal, may be configured such that it comes on upon selection by a user, such as by using a switch (e.g., a wall mounted switch, a remote control, etc.), or may be configured such that it comes on under any other condition requiring a source of light or a condition in which a source of light is desired. In the following description as above, the lighting is denoted as "emergency" lighting. However, as should be evident and as will be described below, the "emergency" lighting is not limited to illuminating only during "emergency" conditions. Rather, the term "emergency" lighting is simply used as a term to designate a source of illumination that may be controlled by any of several types of input such as an emergency signal or operation of a switch by a user during a non-emergency condition.

In an exemplary embodiment, the inventive attachment apparatus is provided normal power and emergency power. As will be described below, the attachment apparatus may be provided normal power and emergency power in a variety of ways. For example, when connected to a sensing detector, the attachment apparatus may receive normal power and emergency power from the sensing detector. Alternatively, the attachment apparatus may receive normal power from a branch circuit of a building in which it is mounted and emergency power from a battery located locally or remotely from the attachment apparatus.

FIG. 1A illustrates an attachment apparatus including emergency lighting according to an exemplary embodiment of the present invention.

Referring to FIG. 1A, an attachment means, such as a mounting bracket 101, is provided in order to mount a sensing detector such as a smoke detector, a fire detector, a carbon monoxide detector, or any detector or similar device to a wall, a ceiling or other surface. The attachment apparatus includes mounting means 103. In the exemplary implementation of FIG. 1A, the mounting means 103 is illustrated as two slotted mounting holes configured to receive a screw, so that the attachment apparatus may be mounted to a wall, a ceiling, or other surface. Of course, it is to be understood that the mounting means 103 may be configured using an alternative means to the slotted mounting holes. For example, the mounting means 103 may include one or more of a hole to receive a screw, a nail, or similar part, may include a slot for coupling to a hook mounted to a wall, a ceiling or other surface, may include a projection for penetrating a wall, a ceiling, or other surface, and the like.

The attachment apparatus further includes attachment means 105 for coupling with a sensing detector. In the exemplary implementation illustrated in FIG. 1A, the attachment means 105 are tabs configured to receive corresponding tabs or protrusions that are coupled to a sensing detector that is to be mounted to the attachment apparatus. Of course, it is to be understood that the attachment means 105 may be configured with means other than the illustrated tabs. Moreover, the attachment means 105 may be alterable or configurable to receive different types and kinds of detectors or other safety devices. In an exemplary implementation, the attachment means 105 may be configured so as to be rotatably connectable to a detector or other device connected thereto. For example, the attachment means 105 may be configured so as to form a mechanical and/or electrical connection with the sensing detector or device as the sensing detector or device is pressed in contact with the attachment apparatus and rotated. As another example, the attachment means 105 may include any of an opening of any shape such as a slot or a hole, a pin or other projection, an indent, a detent, a spring connector, a stationary nut to receive a stud or screw, and the like. Also, the attachment means 105 may include any number of openings, etc. and be formed in any location on the attachment apparatus as needed or desired.

The attachment apparatus further includes an opening 109 formed at a center portion thereof. The opening 109 may be included as a means to reduce overall weight of the attachment apparatus. Of course, the attachment apparatus may be formed without an opening 109, for example if overall weight of the attachment apparatus were not of concern, to address structural necessities, or for any other reason. Further, the opening 109 may be formed as a plurality of openings, wherein the openings may have a variety of shapes and sizes, and the like.

The attachment apparatus may also include connecting means 111 for providing an electrical connection to a sensing detector or other device mounted thereto. In the exemplary implementation illustrated in FIG. 1A, the connecting means 111 includes electrical contacts 113. Electrical contacts 113 may be formed as male or female contacts, and may include any of pins, studs, pads, etc. extending from the attachment apparatus or may include receptacles for receiving pins, studs, pads, etc. on a sensing detector coupled to the attachment apparatus.

In the example of FIG. 1A, the connecting means 111 includes five electrical contacts of which three may be used as an AC connection (i.e., power, neutral, and ground) between the attachment apparatus and a sensing detector mounted thereto, and two may be used as a DC connection (i.e., positive and negative) between the attachment apparatus and the detector mounted thereto. Of course, this is only an example and the connecting means 111 may be provided having a variety of different forms. For example, the connecting means 111 may provide for any number of contacts between the attachment apparatus and the sensing detector, and may include contacts for transferring power as well as contacts for transferring a signal. As an example, a signal may be transferred between a sensing detector and the attachment apparatus regarding an emergency condition (e.g., one sensed by the sensing detector, one of which the sensing detector is aware, etc.), a user control selection (e.g., on/off selection, etc.), a loss of normal power, and the like.

As another example, the connecting means 111 may include wire leads connectable to similar leads provided as part of a branch circuit or from a sensing detector, may include a plurality of connectors such as separate connectors for ac and dc connections, separate connections for control or other signals, or separate connectors for each polarity of a circuit (e.g., three connectors, one each for power, neutral and ground for an AC circuit connection, etc.), may include a connector that establishes an electrical contact as well as a mechanical/structural contact between the attachment apparatus and a detector when the detector is rotated into place, and the like. For example, the attachment means 105 may be configured to provide the function of the connecting means 111 in that it may make both an electrical and mechanical/structural connection with a sensing detector mounted to the attachment apparatus. In such a configuration, the attachment means 105 may include male or female electrical contacts, such as a pin, a stud, a receptacle, an open lead such as a strip of copper, or the like formed on or otherwise coupled to the attachment means 105, and the like. In that case, a sensing detector that is coupled to the attachment means 105 may have corresponding contacts/leads to complete an electrical contact to the attachment apparatus. In an exemplary embodiment, the attachment means 105 may be provided with an open lead type of contact laminated thereon such that, upon coupling and rotation of a sensing detector to the attachment apparatus, corresponding open leads of the sensing detector form an electrical contact with the open leads on the attachment means 105. Of course, this is merely one of many types of electrical contacts that may be made between the sensing detector and the attachment apparatus. Again, although not illustrated in FIG. 1A, the connecting means 111 may be configured to receive an emergency signal, a user controlled signal, a loss of power, and the like. That is, the connecting means 111 is not limited to the exemplary embodiment illustrated in FIG. 1A.

In the embodiment of FIG. 1A, the attachment apparatus further includes a source of emergency power or backup power means 115. In the example of FIG. 1A, the backup power means 115 is provided as a 9 Vdc battery. Of course, as explained above, the source of emergency power may be implemented in any of a variety of ways such as including a plurality of batteries of voltages other than 9 Vdc, a remote power source, and the like. Further, the backup power means 115 may provide power to the attachment apparatus when a normal source of power is lost, and may supply power to a sensing detector coupled to the attachment apparatus as needed. Alternatively, the backup power means 115 may be located on or otherwise coupled to a sensing detector that is coupled to the attachment apparatus. That is, the attachment apparatus may receive both normal power and emergency power from sources external to the attachment apparatus, including sources provided to a sensing detector coupled thereto.

The attachment apparatus further includes an emergency lighting source 107. In the example of FIG. 1A, the attachment apparatus is provided with four emergency lighting sources 107. However, it is to be understood that this is merely for example and not to be considered limiting. That is, the inventive attachment apparatus may include one or more emergency lighting source 107. As described above, the emergency lighting source 107 may be configured to illuminate upon a loss of normal power, upon receipt of an "on" signal such as a signal supplied by a switch controlled by a user (e.g., a wall switch, a remote control, a test switch, etc.), upon receipt of an emergency signal, such as when a sensing detector coupled with the attachment apparatus senses a dangerous condition, and the like. Further, the emergency lighting source 107 may include any of a variety of lighting types (i.e., Light Emitting Diode, etc.). Also, the emergency lighting source 107 may be configurable so as to change an illumination level (e.g., brightness), a focus (e.g., changing a direction of a beam, a width of a beam, etc.), an operation (i.e., always on, on during emergency, on based on user controlled switching, etc.), and the like. Also, if implemented as a plurality of light sources as illustrated in FIG. 1A, the emergency lighting source 107 may provide separate functions for any of the individual light sources. For example, one or more of the emergency lighting sources 107 may provide a night light operation (i.e., on during certain hours, ambient conditions, etc.) while other emergency lighting sources 107 illuminate upon a loss of power, emergency condition, and the like. In that case, the attachment apparatus may further include a motion sensor, a timer (e.g., a clock), an illuminance sensor, and other circuitry so as to control the night light for activation during a certain time, during dark conditions, based on user occupancy, and the like.

In various exemplary implementations, the emergency lighting 107 may be provided not only on a mounting bracket 101 but may also be provided on a sensing detector coupled to the attachment apparatus. Furthermore, although not illustrated, the emergency lighting 107 located on either the sensing detector or the attachment apparatus may be configured such that its illumination intensity can be altered, that its focus or direction of illumination may be changed, that its color may be changed, and the like. Further, one or more of the emergency light 107 located on either the mounting bracket 101 or the sensing detector may function as a night light as described above.

In implementation, the attachment apparatus may include necessary circuitry to detect a loss of normal power. For example, the attachment apparatus may include a relay or solid state device that detects a loss of power and alters the position of a switch in response. Based on the position of the switch, the emergency power is provided to the emergency lighting source 107 so that it may illuminate automatically. Similarly, the attachment apparatus includes necessary circuitry to control the illumination of the emergency lighting source 107 based on the several conditions explained. For example, circuitry is provided so as to illuminate the emergency lighting source 107 upon receipt of an emergency signal, such as a signal provided by a mounted detector when it senses a dangerous condition. In that case, the emergency lighting source 107 may illuminate based on power provided from either the normal power or the emergency power. Depending on implementation, any of such circuitry may be electrically coupled to connecting means 111 so as to detect various conditions such as a loss of normal power or otherwise be provided with appropriate signals.

Although not shown, the attachment apparatus may further include one or more test buttons to determine the status of the secondary or backup power source, the status of the primary power source, the status of the bulbs or LEDs of the emergency lighting sources 107, and the like. In that case, although not shown, the attachment apparatus may further include one or more indicators such as an indicating light, a siren/buzzer, a meter, and the like to provide status indication.

In an exemplary implementation, the attachment apparatus is universal in that mounting means 103 may be configured to mount to any surface such as a wall, a ceiling, a floor, and the like. Further, the attachment apparatus may be universal in that the attachment means 105 is configured to receive and structurally accommodate any of several different kinds, types, or brands of sensing detectors. For example, using the attachment means 105, the attachment apparatus may be configured to receive any of a smoke detector, a fire detector, a carbon monoxide detector, and the like. Moreover, the attachment apparatus may be configured to receive any such detector from any of a plurality of different manufacturers. That is, the attachment means 105 may be configured to be altered to accommodate any of several different types or kinds of detectors. More specifically, the attachment means 105 may be configured having different parts and/or components that are alterable such as parts or components that may be broken off, inserted, re-aligned, adjusted or otherwise re-configured in order that the attachment apparatus is able to accommodate the different types and kinds of detectors. For example, the attachment means 105 may be provided having a plurality of holes in order to accommodate receipt of various locations and arrangements of studs or other physical structures of the various types and kinds of detectors. Similarly, the attachment means 105 may include tabs or other physical structures or elements that may be selectively removed to accommodate different types or kinds of detectors. Further, the attachment means 105 may include removable structures or components that may be selectively inserted or otherwise attached to the attachment apparatus to accommodate any of the different types and kinds of detectors. Of course, the attachment apparatus may also be designed for a single type or kind of sensing detector, depending on variables such as cost, demand, etc.

Although illustrated in FIG. 1A as a having a circular shape, the attachment means, including bracket 101, may have any shape such as a square, a rectangle, a triangle, an oval, etc. as desired or needed to accommodate its mounting to a wall, a ceiling, or any other surface or to accommodate its receiving of an external component such as a sensing detector.

Figure 1B:
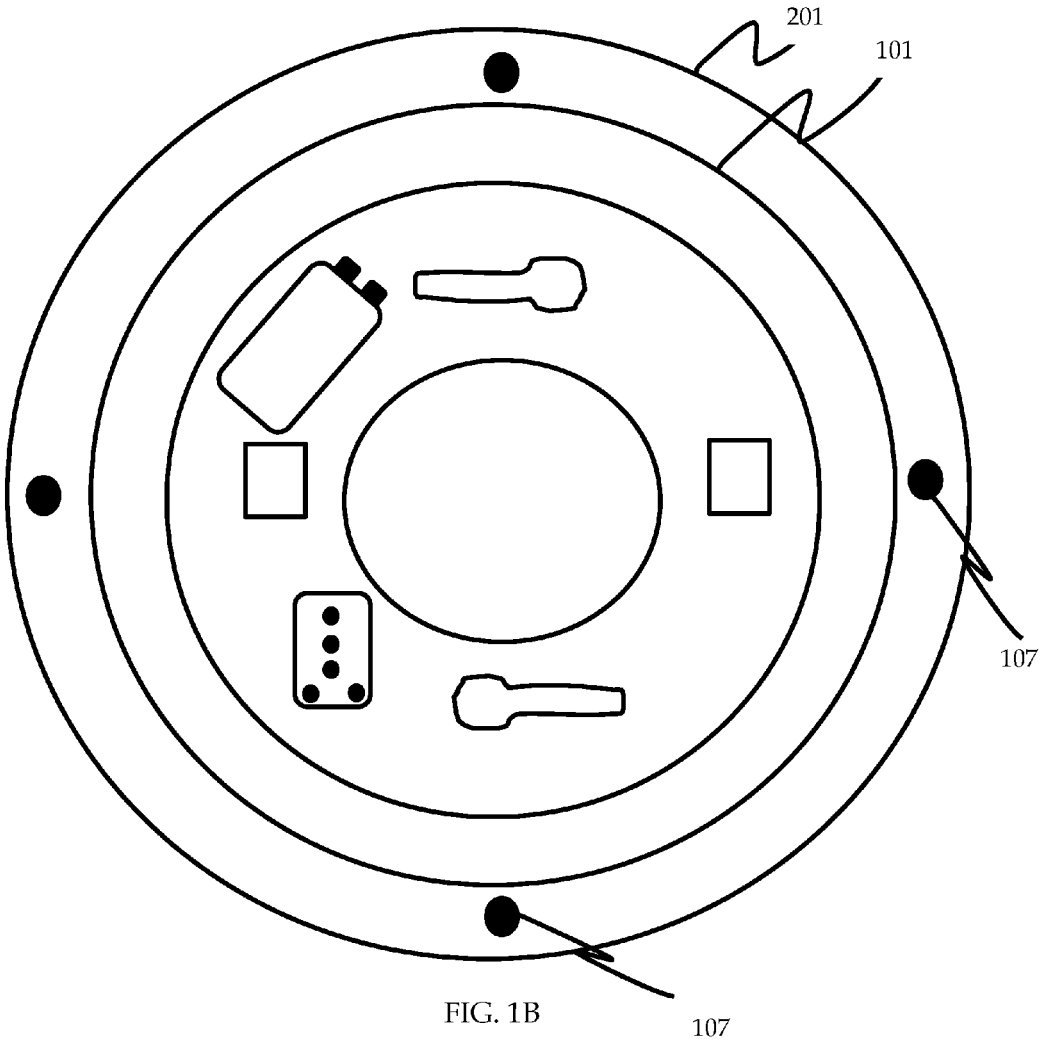
FIG. 1B illustrates an attachment apparatus including emergency lighting according to an exemplary embodiment of the present invention.

FIG. 1B illustrates an attachment apparatus including emergency lighting according to an exemplary embodiment of the present invention.

Referring to FIG. 1B, the attachment apparatus includes at least a first mounting bracket 101 and a second mounting bracket 201. In an embodiment, the first mounting bracket 101 and the second mounting bracket 201 are adjustable with respect to each other. For example, each of the first mounting bracket 101 and the second mounting bracket 201 may be generally shaped like a ring, wherein the first mounting bracket 101 and the second mounting bracket 201 are concentric rings having different diameters. In such an implementation, the first mounting bracket 101 as the first ring may be used, as described above, to receive a sensing detector and provide a structural mounting to a wall, ceiling, etc., while the second mounting bracket 201 as the second ring may be used for mounting of the emergency lighting 107 thereon. In such an implementation, the second ring including the emergency lighting may rotate with respect to the first ring to provide alternatives for the location of the emergency lighting. Also, as needed, an electrical connection may be provided between the first ring and second ring for supply of the primary source of power, the secondary source of power, and/or any electrical switching or signaling.

Figure 1C:
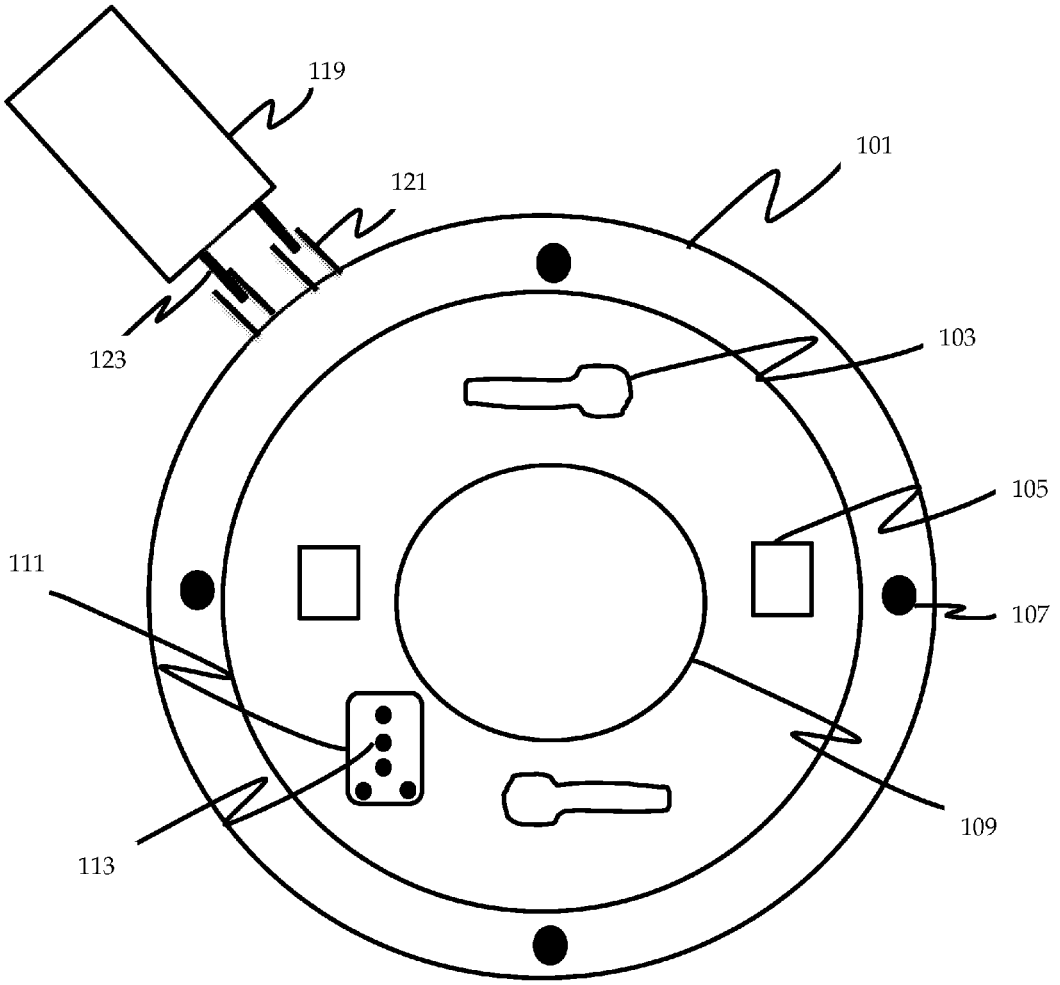
FIG. 1C illustrates an attachment apparatus including emergency lighting according to an exemplary embodiment of the present invention.

FIG. 1C illustrates an attachment apparatus including emergency lighting according to an exemplary embodiment of the present invention Referring to FIG. 1C, the attachment apparatus is provided with a secondary power source that couples to an external surface of the mounting bracket 101. As illustrated in FIG. 1C, the secondary power source includes an enclosure 119 and electrical contacts 123. Though the electrical contacts 123 are illustrated in FIG. 1C as pins, this is merely an example. That is, the electrical contacts 123 may take any of several forms such as wire leads, compression contacts, rotatably connectable contacts, pads, and the like. Furthermore, the mounting bracket 101 is provided with second electrical contacts 121 that correspond to the electrical contacts 123. In the exemplary embodiment of FIG. 1C, the second electrical contacts 121 are illustrated as female connections that may accept the male electrical contacts 123. Again however, this is merely an example and not to be construed as limiting. That is, the second electrical contacts 121 may be implemented with wire leads, compression contacts, rotatably connectable contacts, pads, etc., to correspond and make electrical connection to the electrical contacts 123. Moreover, the electrical contacts 123 and the second electrical contacts 121 may be configured to provide a structural as well as electrical connection between the enclosure 119 and the mounting bracket 101. As an example, the enclosure 119 may be configured for structural/electrical connection with the mounting bracket 101 by means of sliding onto a post or tab, by rotating onto a threaded rod, by inserting into a compression fitting, by being clipped into a detent, by a magnetic force, and the like, wherein each of the post, tab, threaded rod, fitting, detent, etc. includes means for electrically connecting to the enclosure 119.

In an exemplary implementation, the enclosure 119 is provided as a six sided enclosure that may accept a battery. In one embodiment, the enclosure is configured to accept a 9v battery and thus has a corresponding size. Notably, the enclosure 119 may be configured to open or otherwise accept the battery in one or more of a plurality of ways. For example, the enclosure 119 may be hinged such that one or more of a top panel or a side panel can open to accept the battery, may be configured with a spring such that the hinged panel opens on a pressing contact by a user, may have a panel that is attached to the remainder of the enclosure by a screw or other mounting mechanism such that the panel is removable from the remainder of the enclosure, and the like. Moreover, the enclosure 119 may simply be a five sided enclosure in which a battery slides in and makes physical and electrical contact internally to the enclosure 119. Still further, the enclosure 119 may be configured such that the battery is able to slide in, pop in, snap in, and the like. Of course, while a 9 Vdc battery is discussed, this is only an example and the enclosure may be configured to accept any number of batteries having different voltages and ratings (e.g., 4 AA batteries, etc.).

Figure 1D:
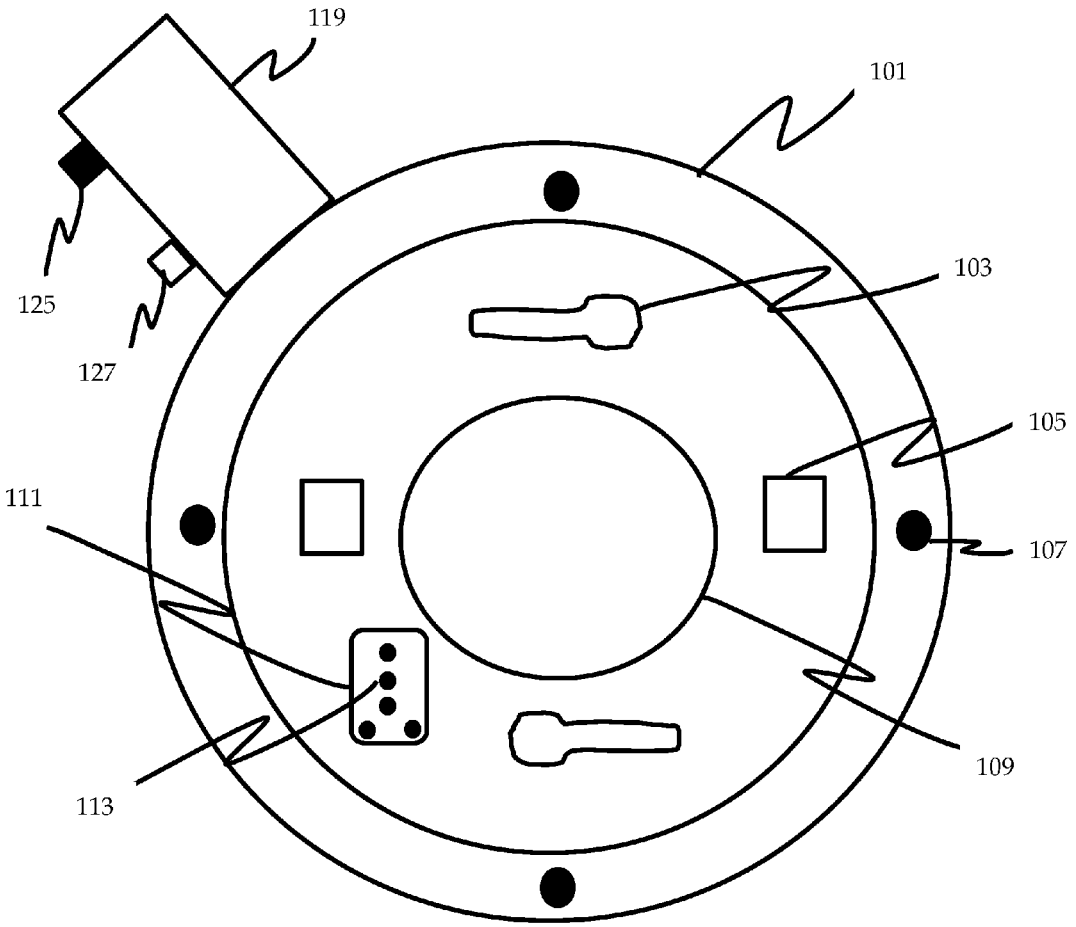
FIG. 1D illustrates an attachment apparatus including emergency lighting according to an exemplary embodiment of the present invention.

FIG. 1D illustrates an attachment apparatus including emergency lighting according to an exemplary embodiment of the present invention Referring to FIG. 1D, the attachment apparatus is again provided with an enclosure 119. However, in the exemplary embodiment of FIG. 1D, the enclosure 119 is coupled directly to the mounting bracket 101 such that the electrical connections between the enclosure 119 and the mounting bracket 101 are internal to the coupling there between. As also illustrated in FIG. 1D, the enclosure may include one or more test button 125 and one or more indicator 127. The one or more test button 125 may be provided as any of a push button, a spring return to normal switch, a toggle switch, and the like. The one or more test button 125 may be provided to test any of a variety of conditions, such as the condition of a dc source located within the enclosure 119, the condition of the emergency light 107 on the attachment apparatus, the condition of a sensing detector coupled to the attachment apparatus, the availability of normal power, the availability of emergency power, the continuity of a connection between the attachment apparatus and a sensing detector, and the like. Moreover, the one or more indicator 127 may be provided as one or more of a light, a meter, an audible alarm, and the like. The one or more indicator 127 may be configured to operate in conjunction with the one or more test button 125, or to operate independently of the one or more test button 125. For example, if the one or more indicator 127 is implemented as a light, the one or more indicator 127 may be configured to illuminate to indicate a successful test of a condition by the one or more test button 125, such as determining if adequate power is available from a dc source located within the enclosure 119. Alternatively, if the one or more indicator 127 is implemented as an audible alarm, it may provide an altering signal when the terminal voltage of a battery located within the enclosure 119 falls below a threshold level. Also, if the one or more indicator 127 is implemented as an audible alarm, it may be configured to provide an alarm at a different frequency than a similar alarm coupled to the sensing detector such that a user is able to distinguish a fault condition based on the sound or frequency of the audible alarm. Also, if the one or more indicator 127 is implemented as a light, it may be configured to illuminate in a specific manner depending on a specific fault condition. For example, the one or more indicator 127 may illuminate continuously in the event of an improper connection between the enclosure and the mounting bracket and may be configured to flash to indicate a condition of a low battery level. Of course, these are all merely examples of different means for implementing the one or more test button 125 and the one or more indicator 127 and not to be construed as limiting. Moreover, although not illustrated, the one or more test button 125 and the one or more indicator 127 may be implemented in any of the embodiments illustrated in FIGS. 1A-1C and be located at any location on the attachment apparatus depending on design requirements, user input, and the like. For example, either or both of the one or more test button 125 and the one or more indicator 127 may be located on the mounting bracket 101, the second mounting bracket 201, or internal to the attachment apparatus, such as at a location near the attachment means 111, the backup power means 115, and the like.

As described above, the inventive attachment apparatus includes an emergency lighting source 107, which may be any of a variety of types of lighting technologies. As an example, the emergency lighting source 107 may be a Light Emitting Diode (LED), a fluorescent light, an incandescent light, a halogen light, a high intensity discharge light, an infrared light, or any similar or new type of lighting. The emergency lighting source 107 may include any number of bulbs, LEDs, and the like. In a preferred embodiment, the emergency lighting source 107 is an LED having relatively low power requirements and relatively high output in comparison to other lighting technologies.

The emergency lighting source 107 may include means for altering the focus or location of its illumination. For example, the emergency lighting may include a lens or other means for focusing or otherwise directing the illumination generated therefrom. Moreover, the emergency lighting may be mounted having the ability to swivel or otherwise have its orientation altered. The emergency lighting may further include light sources of different colors.

In an exemplary implementation, the emergency lighting source may be provided at one or more locations on the attachment apparatus. That is, the emergency lighting source may include one or more bulbs, LEDs, and the like installed at various locations on the attachment apparatus. As an example, the emergency lighting source may be located on a periphery of the attachment apparatus. As another example, the emergency lighting source may be located on a sensing detector or other device attached to the attachment apparatus. The emergency lighting may be adjusted in the direction in which it illuminates, for example towards a desired wall, ceiling, or floor as well as the focus of the radius of the illumination of the emergency lighting, and the illumination intensity. Still further, one or more of the emergency lighting bulbs or LEDs may be eliminated by switching it off, by covering it, by plugging it, etc.

In an exemplary implementation, the attachment apparatus may further include an emergency lighting source 107 for use as a night light. Such a night light may be configured or otherwise controlled to illuminate at certain times of the day or night or during certain ambient lighting conditions, such as by using a dusk-to-dawn photocell. For example, such a night light may be programmed to come on at a certain time and turn off at a certain time. Furthermore, such a night light may be programmed or otherwise controlled to illuminate when ambient lighting conditions are below a threshold. Moreover, such a night light may be controlled by a switch that is activated by a user or be electrically connected to or otherwise detect the position of a room switch in which the night light is located such that, if the position of the room switch indicates that the room is not illuminated, the night light will be illuminated, or otherwise controlled to illuminate under certain conditions, such as low ambient light. In an exemplary implementation, the night light may be configured having a different color of light, or different type of lighting technology than other emergency lights. For example, if the emergency lighting source 107 were implemented using LEDs, the night light may be implemented using a halogen light. Of course, the emergency lighting source 107 and the night light may be implemented using the same type of lighting technology. Also, the night light may be configured such that it illuminates and is controlled as a night light during normal conditions, while illuminating and being controlled as part of the emergency lighting source as conditions may require or as a user may control. Moreover, the night light may be adjusted in the direction in which it illuminates, for example towards a desired wall, ceiling, or floor as well as the focus of the radius of the illumination of the night light, and the illumination intensity. Still further, the night light may be eliminated by switching it off, by covering it, by plugging it, etc.

The attachment apparatus may be configured to have, include, or otherwise receive a primary or normal source of power and a secondary source of power. As an example, a primary source of power could be a branch or other circuit, as provided in a building, which is used to provide normal loads such as lighting. As an example of the secondary source of power, one or more batteries, such as one or more 9 Vdc batteries, rechargeable batteries, or one or more of another voltage of batteries, may be provided. The attachment apparatus may further have the ability to determine if the primary power source is unavailable. The attachment apparatus may also be configured to supply power from the secondary source of power to the emergency lighting when it is determined that the primary source of power is unavailable. For example, if the primary source of power is a branch or other type of circuit providing the normal source of power for lighting in a room or other structure, the attachment apparatus may be configured to determine if the primary source of power is unavailable, and to provide power from the secondary source of power to the emergency lighting included thereon when the primary source of power is unavailable.

The attachment apparatus may be configured to have, include or otherwise receive either or both of the primary and secondary sources of power from a plurality of different inputs. As a first example, the attachment apparatus may be configured to receive the primary source of power as a lead from a branch or other circuit provided in a building. That is, the attachment apparatus may be provided having one or more wires or leads, such as a power lead, a neutral lead and a ground lead, that may be connected to the same or similar wires or leads that are included in the branch or other circuit. As a second example, the attachment apparatus may be provided having a connector for electrical power or other connection to the sensing detector mounted thereon. That is, if the sensing detector itself is provided having leads or another type of electrical connection for receipt of power from a branch or other type of circuit provided in a building, the power received by the sensing detector from the branch or other circuit may be provided as the primary source of power to the attachment apparatus. In that case, the connecting means 111 provided on the attachment apparatus may be configured to accommodate a connector provided on the detector. As an example, a detachable interlocking means may be provided on the attachment apparatus for electrical connection with the sensing detector. Moreover, the connecting means 111 may include a plurality of adaptors to accommodate connectors to and from a variety of different types and kinds of detectors. As an example, the attachment apparatus may be configured such that, upon coupling and rotation of a detector to the attachment apparatus, an electrical connection is established.

As yet another example, the attachment apparatus may receive power from a remote component. As a more detailed example, the attachment apparatus may have an emergency lighting source 107 that is implemented using LEDs that operate at 12 Vdc. In that case, the attachment apparatus may be provided 12 Vdc power from a remote component, wherein the remote component includes a normal source of 12 Vdc power and an emergency source of 12 Vdc power, either of which can be provided to the attachment apparatus. The normal source of 12 Vdc power may be provided by rectifying an ac source of power (e.g., a branch circuit) while the emergency source of 12 Vdc power may be provided by a battery. In that case, the remote component may also include a battery charger and other necessary circuitry to maintain the battery in an operable condition. When implemented using a remote component as the source of normal and emergency power as here described, the attachment apparatus may still be electrically connected to a sensing detector to receive power from or provide power to the sensing detector.

Rather than or in addition to loss of the primary source of power as the signal indicating that the emergency lighting source 107 should illuminate, the attachment apparatus may be configured to receive a signal indicating an emergency or other condition in which lighting provided from the emergency lighting source 107 of the attachment apparatus is required or otherwise desired. For example, the attachment apparatus may be configured to receive a signal indicating a fire or other emergency situation in the building in which it is mounted. A signal received from a sensing detector coupled to the attachment apparatus is one such signal. In such an emergency situation, it may be desired that the emergency lighting source 107 included with the attachment apparatus be illuminated. As it may be included in place of or in addition to the primary source of power, upon receipt of such a signal, the attachment apparatus may be configured to power the emergency lighting source 107 from either the primary source of power or the secondary source of power.

Similarly, rather than or in addition to loss of the primary source of power as the signal indicating that the emergency lighting source 107 should illuminate, the attachment apparatus may be provided with a signal indicating a user's desire that the emergency lighting source of the attachment apparatus provide illumination. For example, the attachment apparatus may be configured having a switch to control the illumination of the emergency lighting source. The switch may be installed remotely such as near a door way or other location and include wiring connected to the attachment apparatus. The remotely installed switch may control illumination of the emergency light source using either the primary or secondary source of power. Alternatively, the switch may be installed locally on the attachment apparatus and be configured to supply power from either the primary or secondary source of power to illuminate the emergency lighting source. As yet another alternative, the switch may be installed on the sensing detector and configured to control illumination of the emergency lighting source. The control of the emergency lighting source using the switch installed on the detector may be provided using the same connector that may provide the primary source of power to the attachment apparatus from the detector or another connector. In another embodiment, the emergency lighting source 107 may be switched using a remote control, in which case the attachment apparatus would further include circuitry (e.g., an antenna, etc.) to receive the wireless signal.

In an exemplary embodiment, the secondary source of power may be provided locally at the attachment apparatus. For example, the attachment apparatus may be configured to have mounted therein or otherwise include or be provided with power from a battery such as a 9v battery. In that case, the locally installed battery would be available to provide power to illuminate the emergency lighting source 107 in the case that the primary source of power is unavailable, if an emergency signal is received, if a switch is turned on so as to connect the secondary source of power to the emergency lighting source, or as otherwise needed or desired. Further, the secondary source of power provided locally at the attachment apparatus may be configured to also supply power to a sensing detector coupled to or otherwise attached to the attachment apparatus. For example, the secondary source of power may supply backup power to the detector in the event power is lost to the detector. Further, the secondary source of power may provide a normal source of power to the detector if the detector is not supplied any other source of power, or as simply desired by a user or designer.

In another exemplary embodiment, the secondary source of power may be provided from a detector that is coupled to the attachment apparatus. For example, the secondary source of power may be a battery installed in or otherwise coupled to the detector. In that case, the connecting means 111 of the attachment apparatus may receive secondary power from the detector. As an example, the connecting means 111 may also be used to provide the primary source of power from the detector to the attachment apparatus described earlier. As another example, a separate connector may be provided if the attachment apparatus is not provided with a primary power source from the detector or simply for convenience.

In yet another exemplary embodiment, the secondary source of power may include a plurality of batteries. Moreover, the plurality of batteries may be located at either the attachment apparatus or at a detector attached or otherwise coupled to the attachment apparatus. Furthermore, either or all or any number of the plurality of batteries may be configured to supply power to either the attachment apparatus or an attached or otherwise coupled detector, regardless of their location.

In still another exemplary implementation, the attachment apparatus may include an indicator for indicating that the primary source of power is available, an indicator for indicating that the secondary source of power is available, an indicator for indicating that the primary source of power is available from a detector coupled thereto, and an indicator for indicating that the secondary source of power is available from a detector coupled thereto. The attachment apparatus may also include a test circuit such as a button that may be pressed to ensure operability of the emergency lighting source. Moreover, the attachment apparatus may have one or more indicators, such as one or more lights or an audible alarm that will indicate a fault, such as a low battery condition. The attachment apparatus may further have means to disable or otherwise deactivate the emergency lighting source. The attachment apparatus may also accommodate an external device other than a detector such as an adjustable light, an exit sign, a directional light, a focusable image light, and the like. The external device other than the detector may also include an external electrical connection for receiving power, ground and signal lines.

Figure 2:
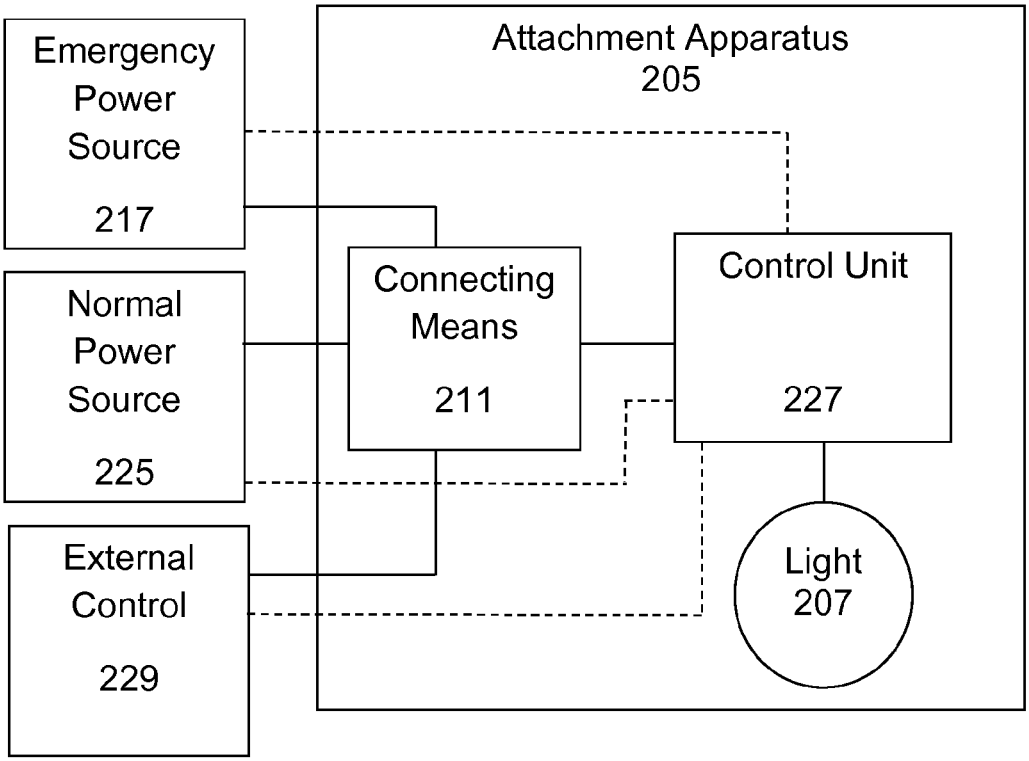
FIG. 2 is a block diagram illustrating an attachment apparatus according to an exemplary embodiment of the present invention.

FIG. 2 is a block diagram illustrating an attachment apparatus according to an exemplary embodiment of the present invention.

Referring to FIG. 2, an attachment apparatus 205 includes a connecting means 211, a control unit 227, and an emergency light 207.

As described above regarding connecting means 111, connecting means 211 may provide for electrical connection to a sensing detector coupled to the attachment apparatus 205, to a branch circuit provided from a building (i.e., normal power source 225), to a source of emergency power (i.e., emergency power source 217), to a source of control (i.e., external control 229), etc. That is, the connecting means 211 may receive power from either or both of the emergency power source 217 and the normal power source 225. As illustrated in FIG. 2 and as explained above, both the emergency power source 217 and the normal power source 225 can be provided and connected in a plurality of ways. Hence, both the emergency power source 217 and the normal power source 225 are shown with a solid line connection to the connecting means 211 as well as a dashed line connection directly to the control unit 227. In other words, depending on the system arrangement, either or both the emergency power source 217 and the normal power source 225 may be directly connected to the control unit 227 without connection to connecting means 211. Furthermore, although illustrated as external components to the attachment apparatus 205, either or both the emergency power source 217 and the normal power source 225 may be components internal to the attachment apparatus. For example, the emergency power source 217 may include a battery located internal or otherwise connected to the attachment apparatus.

External control 229 is provided for a variety of purposes. For example, external control 229 may include an external switch allowing a user to control the emergency lighting 207 as desired. In addition, external control 229 may provide a signal, such as a signal indicating an emergency condition, to the control unit 227 which indicates that the emergency lighting 207 should be illuminated. As described above, such a signal from the external control 229 may originate from a sensing detector coupled to the attachment apparatus 205, from a detector remote from the attachment apparatus 205, from a remote control panel, from a wireless source, and the like. Accordingly, the external control 229 is illustrated as having a direct connection to the control unit 227 as well as having an indirect connection through the connecting means 211. Also, although described as an external component, parts of or the entirety of the external control 229 may be internal to the attachment apparatus 205. For example, the external control 229 may include a user controlled switch such as an on/off toggle switch or a push-button test switch located within or otherwise coupled to the attachment apparatus 205.

The control unit 227 provides control of emergency lighting 207 based on any of a variety of input. For example, the control unit 227 may control to power emergency light 207 upon a loss of the normal power source 225, upon receipt of an emergency signal or a user selection signal from the external control 229, and the like. For example, the control unit 227 may include a detector for sensing a loss of normal power 225.

Although not illustrated, the attachment apparatus 205 may include additional components. For example, the attachment apparatus 205 may include any number of indicator lights, annunciators, meters, etc. that may be used in conjunction with test switches and the control unit 227 to provide an indication of various parameters of the attachment apparatus. Such parameters, as described above, may include a status of emergency power source 217, a status of normal power source 225, a status of emergency lighting 207, and the like. Also, depending on implementation, the attachment apparatus 205 may include charging circuitry if the emergency power source 217 is implemented as a rechargeable battery. In that case, charging circuitry may receive and rectify power from the normal power source 225 to charge the battery. Furthermore, the charging circuitry may be controlled by control unit 227. As another example, the attachment apparatus 205 may include a night light and/or a motion sensor, photocell, etc. as discussed above. In that case, any or all of such components may include one or more connections to the control unit 227.

Attachment Apparatus Having a Lighting Source and Assisting in Egress

As another inventive concept of the present invention, the above described attachment apparatus may further include, or be separately provided with directional lighting that may be used for guidance towards an exit or other path for egress out of a building.

Figure 3A:
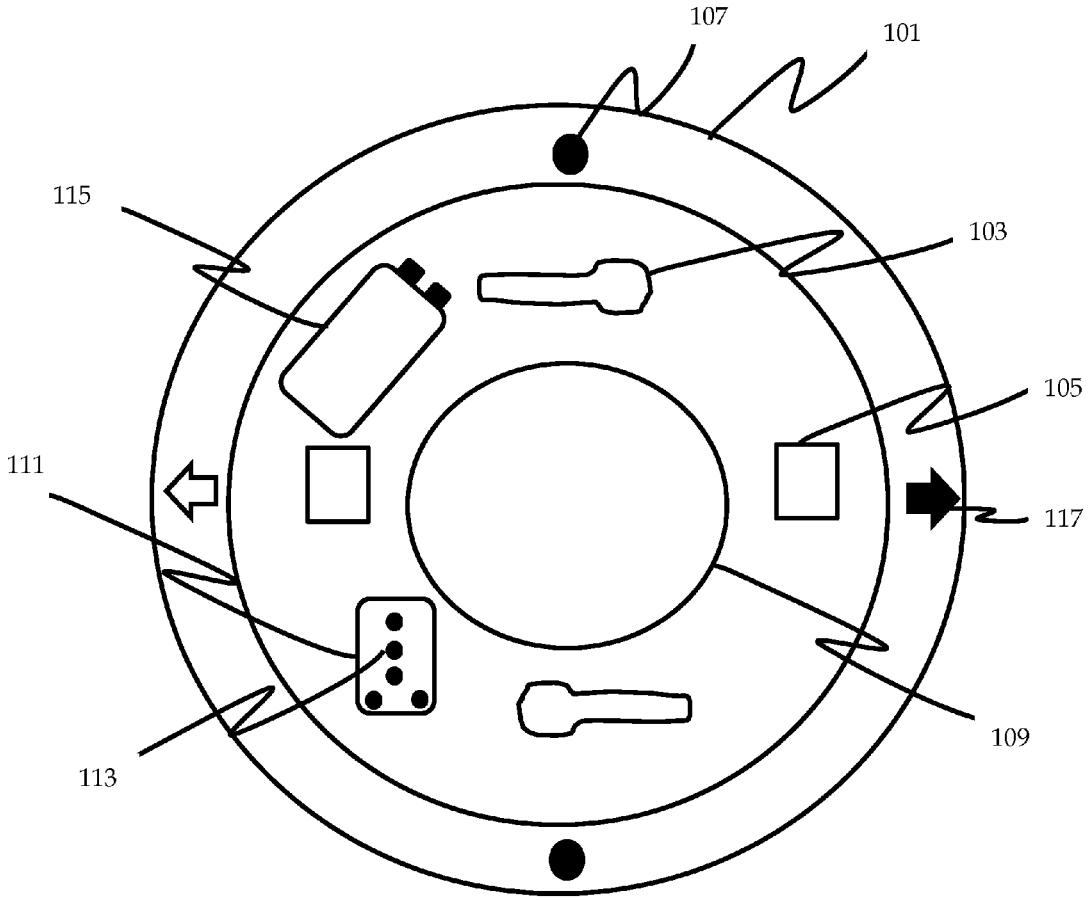
FIG. 3A illustrates an attachment apparatus including emergency lighting and directional lighting according to an exemplary embodiment of the present invention.

FIG. 3A illustrates an attachment apparatus including emergency lighting and directional lighting according to an exemplary embodiment of the present invention.

Referring to FIG. 3A, the attachment apparatus may include the components and/or parts as described above, for example in FIGS. 1A-1D. Moreover, the attachment apparatus may further include directional lighting 117.

In the illustrated exemplary embodiment, the attachment apparatus includes directional lighting 117 in the form of arrows. Moreover, the arrows are illustrated wherein one arrow is illuminated while another arrow is not illuminated. This illustration thus demonstrates a condition in which safe egress may be found in only one direction. It is to be understood that the directional lighting 117 illustrated in FIG. 5 is merely an example. That is, while two directional lights are illustrated, this is not to be considered limiting in that one or more than one directional lights may be provided. Moreover, while the directional lights are shown wherein one is illuminated and another is not illuminated, this should not be considered limiting. For example, if the attachment apparatus were provided such that it did not receive a signal indicating a direction for safest egress or a signal indicating a path for which egress was not safe, both directional lights may illuminate upon a loss of power event, an emergency event such as a fire, or similar condition. Alternatively, the directional lighting 117 may be constantly illuminated when a power source is available. Also, while arrows are illustrated in FIG. 3A as the directional lighting 117, this is also merely an example and the directional lighting 117 may include a variety of different types. For example, the directional lighting 117 may include text or an image that is illuminated to show a safe or unsafe path for egress, or may include different colors of light. Furthermore, although not illustrated, the directional lighting 117 may be located on either the attachment apparatus a detector coupled thereto and may be configured such that its illumination intensity can be altered, that its focus or direction of illumination may be changed, that its color may be changed, and the like.

Figure 3B:
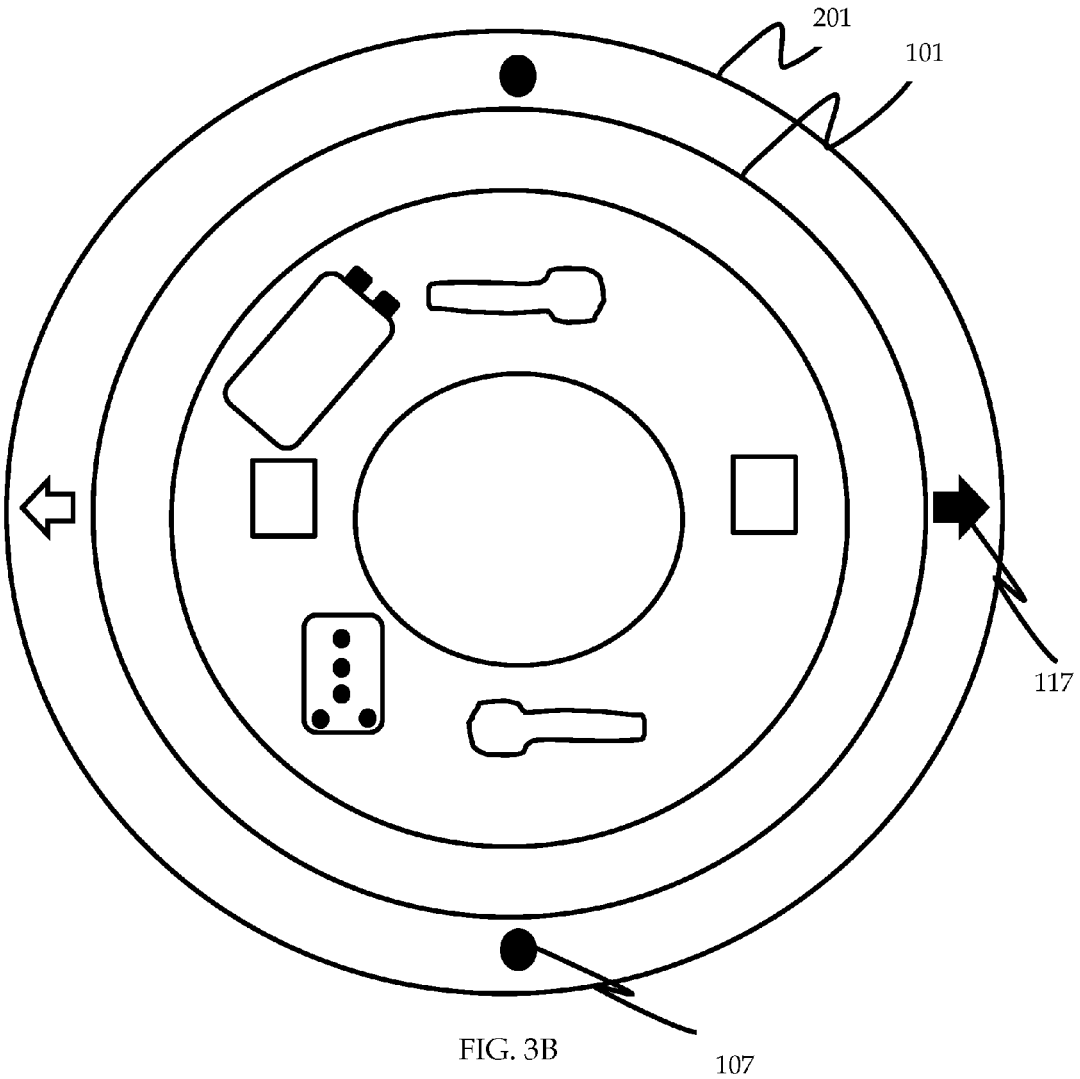
FIG. 3B illustrates an attachment apparatus including emergency lighting and directional lighting according to an exemplary embodiment of the present invention.

FIG. 3B illustrates an attachment apparatus including emergency lighting and directional lighting according to an exemplary embodiment of the present invention.

In the exemplary implementation of FIG. 3B, an attachment apparatus includes emergency lighting 107 and directional lighting 117. The directional lighting 117 will be explained in more detail below. Though not numbered, the attachment apparatus further includes mounting means, attachment means, an opening, and connecting means as described above with reference to FIGS. 1A-1D. Notably, the exemplary attachment apparatus includes a mounting bracket 101 as well as a second mounting bracket 201. As described above, the mounting bracket 101 and second mounting bracket 201 may be coupled together in a manner that allows movement in relation to each other. In the illustrated exemplary embodiment, the second mounting bracket 201 is rotatable with respect to the mounting bracket 101. In that case, either the mounting bracket 101 or the second mounting bracket 201 may be configured to include mounting means such that the mounting bracket 101 or second mounting bracket 201 remains stationary once the attachment apparatus is mounted to a wall, ceiling or other structure. Further, and as an example only, if the mounting bracket 101 is configured with the mounting means such that it remains stationary when the attachment apparatus is mounted to a wall, a ceiling, etc., the second mounting bracket 201 may be configured to rotate with respect to the mounting bracket 101. In such a configuration, the orientation of the emergency lighting 107 and the directional lighting 117 may be altered depending on the user's needs, orientation or location of a path for egress, etc. That is, the second mounting bracket 201 may rotate with respect to the mounting bracket 101 as needed such that the emergency lighting 107 and/or the directional lighting 117 are oriented as needed or desired. Moreover, although not illustrated, there may be an electrical connection provided between the mounting bracket 101 and the second mounting bracket 201.

In an exemplary implementation, the directional lighting 117 may be provided and controlled so as to illuminate only during an emergency condition. That is, the directional lighting 117 may be configured such that it illuminates only upon receipt of an emergency signal, such as an emergency signal provided by a detector coupled to the attachment apparatus when the detector senses a dangerous condition, or an emergency signal received from a source other than the detector, such as an emergency control panel. Moreover, the directional lighting may illuminate upon a loss of power, in a similar manner to the manner in which the emergency lighting source described above operates. Further, the emergency lighting source described above may be configured or otherwise controlled not to illuminate in a situation in which a dangerous condition is sensed by a detector coupled to the attachment apparatus. For example, if a smoke detector that is coupled to the attachment apparatus detects smoke, thus potentially indicating a fire condition, the directional lighting may illuminate while the emergency lighting source may not illuminate to avoid potential confusion between the two. That is, the emergency lighting source may not illuminate such that the directional lighting is not obfuscated. Of course, the emergency lighting source may be configured or otherwise controlled to illuminate concurrently with the directional lighting during a dangerous condition, such as a fire condition. Alternatively, the directional lighting may be configured to illuminate at all times that either the primary or secondary source of power is available.

The directional lighting may be provided for guidance purposes and may include an illumination such as shining a light, which may further include an image and/or wording, on a wall, ceiling, floor, or other surface, directed towards an exit or other pathway for egress.

In an exemplary implementation, the directional lighting may be provided using the same or a different type of technology as described above concerning the emergency lighting source. That is, the directional lighting may be any of an LED, a fluorescent light, an incandescent light, a halogen light, a high intensity discharge light, an infrared light, a low power laser, or any similar or new type of lighting. The directional lighting may include any number of individual bulbs, LEDs, and the like.

In an exemplary implementation, the directional lighting may be provided at one or more locations on the attachment apparatus. That is, the directional lighting may include one or more bulbs, LEDs and the like installed at various locations on the attachment apparatus. As an example, the directional lighting may be located on a periphery of the attachment apparatus. As another example, the directional lighting may be located on a detector coupled to the attachment apparatus.

In an exemplary implementation, the attachment apparatus may be installed having any of various orientations such that the directional lighting 117 is configured to illuminate an exit or a path for egress. For example, if the directional lighting 117 includes a single source of light, such as a single LED, the attachment apparatus may be mounted having an orientation such that the directional lighting illuminates an exit or path for egress. As another example, if the directional lighting 117 includes two sources of light, each of which is installed at a position opposite of the other (e.g., at positions 180 degrees apart from each other with respect to their mounting positions on an attachment apparatus), the attachment apparatus may be installed having an orientation in which the directional lighting illuminates an exit or path for egress in opposite directions. As yet another example, the directional lighting 117 may include three sources of light arranged or otherwise installed at points of 0°, 90° and 180°. In such a case, the attachment apparatus may be installed above a doorway such that the light sources at 0° and 180° illuminate a path down a hallway in which the doorway is located, while the light source at 90° illuminates the doorway. Of course, these are merely three examples of the directional lighting and are not to be considered a limitation of the inventive concept. Rather, the directional lighting may include any number of light sources and be configured to illuminate any number of paths of egress, doorways, and the like. Moreover, the light sources may be configured to provide an indication as to a path not to be taken during an emergency. That is, the directional lighting may be configured to illuminate or project "do not enter" wording, or other wording or another type of indication, such as a circle with a line there through, towards a path that is not considered safe during an emergency. For example, the directional lighting may illuminate or project the wording "do not use" on the doors of an elevator if a fire or other dangerous condition is detected.

The attachment apparatus may include a mechanism by which the orientation of the attachment apparatus may be altered. For example, the attachment apparatus may include a first attachment means mountable to a wall, ceiling or other surface and a second attachment means configured to receive a detector. The first attachment means may be attached or otherwise coupled to the second attachment means in a manner in which the first attachment means is rotatable with respect to the second attachment means. By this configuration, the orientation of the directional lighting may be altered without the need for re-attaching the attachment apparatus to the mounting surface. That is, the attachment apparatus having the first and second attachment means may simply be rotated in order that the directional lighting is pointed or otherwise located in a desired direction or position. In other words, the attachment apparatus can be rotated for directional purposes such as shining a light, including an image and/or wording, on the wall ceiling or floor, towards an exit or other pathway for exiting, or for deterring an exit.

The directional lighting may include means for altering the focus or location of its illumination. For example, the directional lighting may include a lens or other means for focusing or otherwise directing the illumination generated therefrom. Moreover, the directional lighting may be mounted having the ability to swivel or otherwise have its orientation altered. The directional lighting may further include light sources of different colors to indicate a path for safe egress or a path not to be used during an emergency. For example, the directional lighting may shine a green light towards a path for safe egress and a red light towards a path that is considered dangerous. In another alternative, the directional lighting may only shine a light in a direction of a safe path for egress without shining any light towards a path that is considered dangerous or otherwise undesired.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A mounting bracket for supporting a detachable device, comprising:

a base adapted to be coupled to a main power source;

a mounting assembly disposed on the base for coupling the base to a surface;

an attachment assembly on the base adapted to selectively attach the detachable device to the exterior of the base, the attachment assembly having a circular recess, a connector adapted to be in electrical communication with the detachable device, and at least one mount tab adapted to mate with corresponding mount tab on the detachable device;

the detachable device comprising a sensing detector;

at least one light source disposed on the base and being separate from the detachable device, wherein the at least one light source comprises at least one directional indicia indicating at least one predetermined direction;

an alternative power source coupled to the base, the alternative power source providing power upon failure of the main power source; and a control unit, the control unit being operatively coupled to the detachable device through the connector thereby facilitating generation of control signals based on sensed environmental conditions, the control unit controlling power distribution between at least the main power source and the alternative power source.

2. The mounting bracket for supporting a detachable device according to claim 1, wherein said mounting assembly comprises at least one elongate mount slot formed on said base, said at least one elongate mount slot facilitating adjustable mounting of said base onto the surface.

3. The mounting bracket for supporting a detachable device according to claim 1, wherein said at least one light source comprises at least one LED.

4. The mounting bracket for supporting a detachable device according to claim 1, wherein said alternative power source comprises at least one battery.

5. The mounting bracket for supporting a detachable device according to claim 4, wherein said at least one battery comprises an external power enclosure detachably coupled to said base.

6. The mounting bracket for supporting a detachable device according to claim 5, wherein said external power enclosure includes at least one test button, wherein the at least one test button is in electrical communication with at least said alternative power source.

7. The mounting bracket for supporting a detachable device according to claim 6, wherein said external power enclosure further includes at least one indicator, the at least one indicator adapted to indicate a predetermined condition.

8. The mounting bracket for supporting a detachable device according to claim 1, further comprising an external control coupled to said control unit, said external control facilitating remote control of components on said base.

9. The mounting bracket for supporting a detachable device according to claim 1, further comprising an auxiliary base coupled to said base, said auxiliary base facilitating rotary movement between said base and said auxiliary base.

10. In combination, a mounting bracket and a detachable device mounted to the mounting bracket, comprising:

the mounting bracket having;

a base adapted to be coupled to a main power source;

a mounting assembly disposed on the base for coupling the base to a surface;

an attachment assembly on the base to selectively attach the detachable device to the exterior of the base, the attachment assembly having a circular recess, a connector in electrical communication with the detachable device, and at least one mount tab mating with a corresponding mount tab on the detachable device; the detachable device comprising a sensing detector;

at least one light source disposed on the base and being separate from the detachable device, wherein the at least one light source comprises at least one directional indicia indicating at least one predetermined direction;

an alternative power source coupled to the base, the alternative power source providing power upon failure of the main power source; and a control unit, the control unit being operatively coupled to the detachable device through the connector thereby facilitating generation of control signals based on sensed environmental conditions, the control unit controlling power distribution between at least the main power source and the alternative power source.

11. The combination of mounting bracket and detachable device according to claim 10, wherein said mounting assembly comprises at least one elongate mount slot formed on said base, said at least one elongate mount slot facilitating adjustable mounting of said base onto the surface.

12. The combination of mounting bracket and detachable device according to claim 10, wherein said at least one light source comprises at least one LED.

13. The combination of mounting bracket and detachable device according to claim 10, wherein said alternative power source comprises at least one battery.

14. The mounting bracket for supporting a detachable device according to claim 13, wherein said at least one battery comprises an external power enclosure detachably coupled to said base.

15. The mounting bracket for supporting a detachable device according to claim 14, wherein said external power enclosure includes at least one test button, wherein the at least one test button is in electrical communication with the at least said alternative power source.

16. The mounting bracket for supporting a detachable device according to claim 15, wherein said external power enclosure further includes at least one indicator, the at least one indicator adapted to indicate a predetermined condition.

17. The combination of mounting bracket and detachable device according to claim 10, further comprising an external control coupled to said control unit, said external control facilitating remote control of components on said base.

18. The combination of mounting bracket and detachable device according to claim 10, wherein said sensing detector comprises a detector selected from a group consisting of a smoke detector, a fire detector, a carbon monoxide detector, and audio detector.

19. The mounting bracket for supporting a detachable device according to claim 10, further comprising an auxiliary base coupled to said base, said auxiliary base facilitating rotary movement between said base and said auxiliary base.

* * * * *